US008591201B2

(12) United States Patent
Eysymontt

(10) Patent No.: US 8,591,201 B2
(45) Date of Patent: Nov. 26, 2013

(54) HYDRAULICALLY DRIVEN MACHINE IMPROVEMENT

(75) Inventor: Jan Eysymontt, Nyon (CH)

(73) Assignee: Garniman S.A., Montevideo (UY)

( * ) Notice: Subject to any disclaimer, the term of this patent is extended or adjusted under 35 U.S.C. 154(b) by 509 days.

(21) Appl. No.: 12/933,122

(22) PCT Filed: Mar. 20, 2008

(86) PCT No.: PCT/IB2008/051062

§ 371 (c)(1),
(2), (4) Date: Sep. 17, 2010

(87) PCT Pub. No.: WO2009/115866

PCT Pub. Date: Sep. 24, 2009

(65) Prior Publication Data

US 2011/0020150 A1 Jan. 27, 2011

(51) Int. Cl.
*F04B 17/00* (2006.01)
*F04B 35/02* (2006.01)

(52) U.S. Cl.
USPC ..... 417/392; 417/399; 417/472; 92/34

(58) Field of Classification Search
USPC ..... 417/398, 399, 472; 92/34–47
See application file for complete search history.

(56) References Cited

U.S. PATENT DOCUMENTS 2,268,898 A * 1/1942 Pelouch ..... 91/342
2,521,566 A 9/1950 Carey

FOREIGN PATENT DOCUMENTS

EP 1947331 7/2008
WO 2005/119063 12/2005
WO WO 2005119063 A1 * 12/2005 ..... F04B 43/113

* cited by examiner

*Primary Examiner* — Charles Freay
*Assistant Examiner* — Philip Stimpert
(74) *Attorney, Agent, or Firm* — Sturm & Fix LLP

(57) ABSTRACT

A hydraulically driven diaphragm pumping machine comprises a plunger (6) that is slidably mounted in a middle part of the inside of the machine's hydraulic cylinder (5) between first and second bellow-like diaphragms (4,10). Ends of the plunger (6) are connected to the first and second bellows-like diaphragm (10) to define respective first and second outer annular spaces (a) that are independent of one another, and the pressure of fluid in the first annular space (a) is independent of the pressure of fluid in the second annular space (a). The machine may also comprise a hydromechanical switch for commutating a valve (102) to automatically control the supply of hydraulic fluid to the hydraulic cylinder at given moments of the machine's cycle.

9 Claims, 4 Drawing Sheets

HYDRAULICALLY DRIVEN MACHINE IMPROVEMENT

FIELD OF THE INVENTION

The invention relates to hydraulically driven machines, in particular for pumping difficult-to-pump fluid materials, like minerals, ores, sludges, suspensions, slurries, and gels. These pumping machines may be referred to herein simply as pumps or machines.

BACKGROUND OF THE INVENTION

Conventional pumping machines that can be used for difficult-to-pump materials have displacement organs such as pistons, plungers, peristaltic hoses etc. However such displacement organs are subject to frictional wear and the drive of the machine is not properly isolated from the pumped material.

WO 2005/119063 discloses a hydraulically driven multi-cylinder diaphragm pumping machine, in particular for pumping difficult-to-pump materials. This pumping machine comprises a plurality of pump cylinders each having one end with an inlet and outlet for fluid to be pumped and another end with an inlet and outlet for hydraulic fluid. These inlets and outlets can be a separate inlet and outlet (for the hydraulic fluid) or a combined inlet/outlet (for the fluid material being pumped). The inlets and outlets are associated with respective inlet and outlet valves.

In such machine, a separator is located inside and is movable to-and-fro along each pump cylinder. The movable separator has one side facing the pumped-material end of the cylinder and another side facing the hydraulic-fluid end of the cylinder. This movable separator is connected to the inside of the pumped-material end of the cylinder by a first flexible diaphragm in the form of a concertina-like bellows that is expandable and contractable inside the cylinder along the length direction of the cylinder as the movable separator moves to-and-fro along the cylinder. The movable separator delimits a first chamber inside the first bellows-like flexible diaphragm for containing a variable volume of pumped fluid in communication via the inlet and outlet with a pumped fluid manifold and circuit. The movable separator is connected also to the inside of the second end of the cylinder by a second flexible diaphragm in the form of a concertina-like bellows that is contractable and expandable along the length direction of the cylinder in correspondence with expansion and contraction of the first flexible diaphragm. The second side of the movable separator delimits a second chamber inside the second expandable and contractable diaphragm for containing a variable volume of hydraulic fluid in communication with the second inlet and outlet. An annular space is defined between the outside of the first and second diaphragms and the inner wall of the pump cylinder which annular space in use contains a fluid that is the same as said hydraulic fluid or has similar hydraulic characteristics.

This pumping machine is directly driven by a hydraulic pump drive, greatly simplifying the machine and providing simple means of variation and control of the flow of the pumped fluid delivered. Moreover, the double diaphragm arrangement provides a double protection of the pumped fluid from the pumping fluid.

Further details of this pumping machine are described in WO 2005/119063 the contents whereof are incorporated herein by way of reference.

Supplemental research with such machines has demonstrated that various aspects such as the reliability of the operation of the bellows-like diaphragm could be improved.

SUMMARY OF THE INVENTION

This invention aims to improve a machine of the above-mentioned type or more generally other hydraulically-operated machines.

One aspect of the invention relates to an improvement of the hydraulic machine as set out above wherein the movable separator is in the form of a plunger that is slidably mounted inside a middle part of the inside of the cylinder between the first and second bellows-like diaphragms, one end of the plunger being connected to the first bellows-like diaphragm and the other end of the plunger being connected to the second bellows-like diaphragm to define respective first and second annular spaces, namely a first annular space between the outside of the first bellows-like diaphragm and the inner wall of the pump cylinder and a second annular space between the outside of the second bellows-like diaphragm and the inner wall of the pump cylinder, wherein the first and second annular spaces are independent of one another and the pressure of fluid in the first annular space is independent of the pressure of fluid in the second annular space.

Preferably, the plunger is slidably mounted in a sealing element secured inside a middle part of the inside of the cylinder. In this way, the first and the second annular spaces are not coupled together, and the fluid pressure values in these two cavities may be different and independent from each other. The outer diameter of the plunger corresponds to the median working diameter of the first and second bellows-like diaphragms and the volume of the first and second spaces remains essentially constant during operation.

The above-described inventive arrangement results in eliminating or greatly reducing radial deformation of the bellows-like diaphragms resulting in greater reliability and enhanced life for the diaphragms.

Another aspect of the hydraulic machine as set out above or generally any other hydraulic machine is that it comprises a hydraulic cylinder having a part mounted for cyclic reciprocating linear motion along the hydraulic cylinder, and means for commutating a valve to control the supply of hydraulic fluid to the hydraulic cylinder at given moments of the machine's cycle, wherein the valve commutating means comprises a hydromechanical switch comprising: a linkage for converting linear motion of said machine part into rotary motion; a cam rotatably driven by said linkage; and a spring arranged to be compressed to store energy by rotation of the cam during a stroke of said machine part, and arranged to release its stored energy to commutate said valve for controlling the supply of hydraulic fluid to the hydraulic cylinder of the machine when said part reaches it's given positions along the hydraulic cylinder.

The spring can be a compression spring mounted on an arm extending from the cam such that, upon rotational drive of the cam by the linkage, the end of the spring adjacent the cam is compressed until the spring reaches an unstable equilibrium point past which the spring releases its stored energy to commutate said valve. For example, when the spring releases its stored energy it firstly abruptly drives the cam and after the cam has turned through a given angle the cam rotates a part to commutate the valve. The linkage can be arranged to turn the cam through an angle less than 180° for each stroke of said machine part.

By the use of this hydromechanical switch, the hydraulic machine can be operated without the need for electromagnetically actuated and electronically controlled directional valves and as a result the machine is less complicated and more reliable.

This commutation device also relates to any hydraulic cyclical working machine having a linear moving operating part and requiring to be automatically controlled via openings commutation in order to achieve desired working cycle parameters e.g. pressure values, cycle phases duration, etc.

Further aspects and advantages of the invention are set out in the detailed description and particular features of the invention are set out in the claims.

BRIEF DESCRIPTION OF THE DRAWINGS

The accompanying schematic drawings, given by way of example, show embodiments of the hydraulically driven pumping machine according to the invention. In the drawings.

DETAILED DESCRIPTION

The principal improvement of the invention relates to a plunger device to provide fluids separation and, as a subsidiary aspect to a hydromechanical switch, it being understood that these two aspects can be incorporated individually or together in a hydraulically driven pumping machine.

Plunger Separating Fluids

Figure 1:
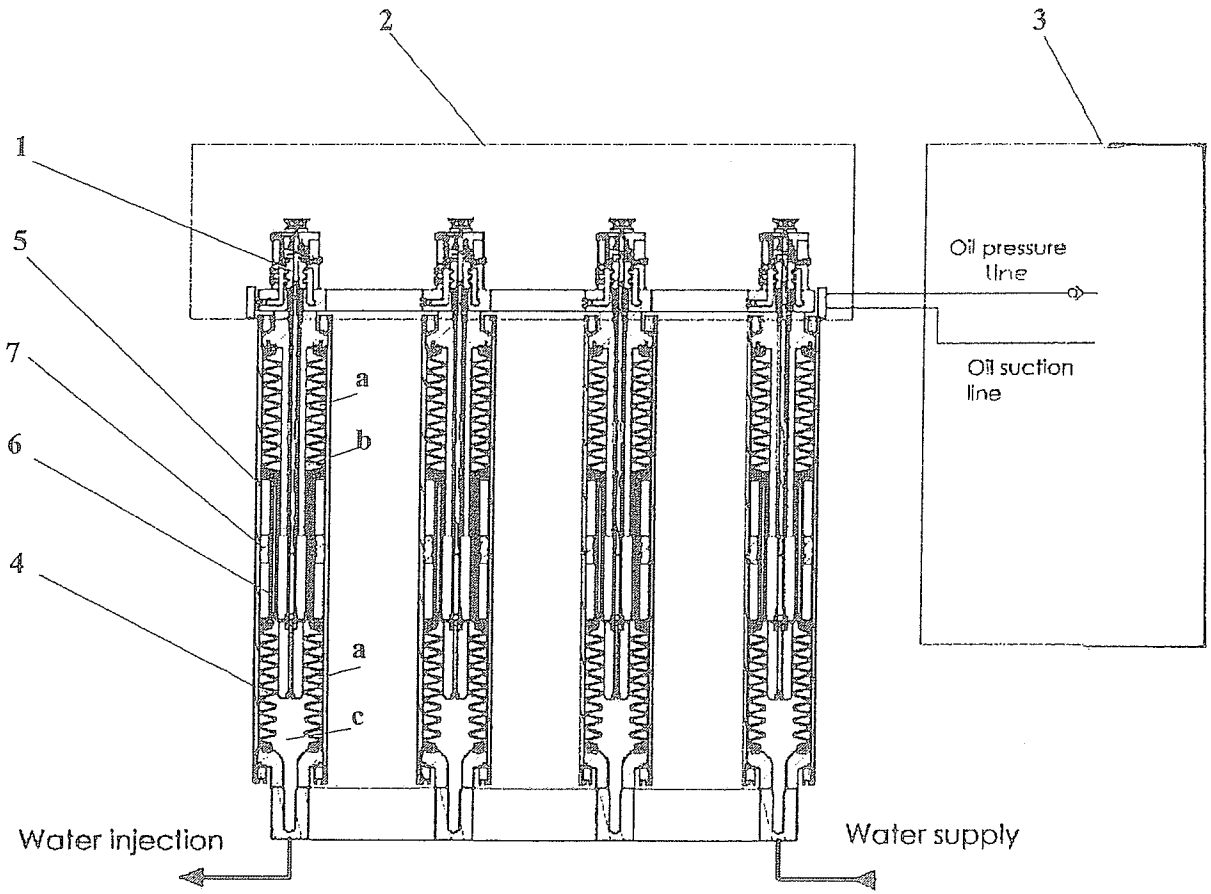
FIG. 1 is a view of one embodiment of a pumping machine according to the invention having four cylinders, for example.

The hydraulically driven pumping machine shown in FIG. 1 comprises one or several cylinders 5, a switching control system 2 and a hydraulic drive unit 3. The machine is normally a multicylinder machine and such basic hydraulic multicylinder machine is described in detail in PCT patent application WO 2005/119063.

To enhance the life of the bellows-like diaphragms, namely to eliminate their radial deformation under pressure differentials arising between internal and external bellows cavities, the basic machine described in WO 2005/119063 was improved in the following way.

The pump's cylinder 5 contains two bellows 4 and 10 (see FIG. 2) mechanically connected to each other via a plunger 6 which moves during the working cycle inside a ring-shaped sealing element 7 mounted in the middle-height part of the cylinder 5. The plunger-sealing assembly 6/7 replaces the separator employed in the previous design.

Two oil-filled "a" cavities are located externally of the bellows 4 and 10 inside the cylinder 5. The plunger 6 is hydraulically obturated in the sealing element 7. This allows keeping each of the "a" cavities volume independent from each other. The plunger outside diameter is also equal to the average efficient diameter of the bellows. This allows keeping each of the "a" cavities volume constant during the plunger working movement. Therefore, the pressure values in each of the bellow's external "a" cavities is exactly piloted by pressure value in the corresponding bellow's internal cavity "b" or "c".

The pressure in the internal bellows cavities "b" and "c" varies between the suction and discharge cycles and it depends on the machine working mode. The "b" cavity is located inside the bellows-like membrane 10 and the "c" cavity is located inside the bellows-like membrane 4.

During each of the machine working cycle phases, the "b" and "c" cavities pressure values are nearly equal, since the driving cavity pressure is transmitted to the driven cavity through the plunger 6 cover. For instance, during the suction stroke the "c" cavity is driving, the "b" cavity is driven; and vice versa during the discharge stroke. For this to happen, the hydraulic pressure must enter the machine under sufficient pressure to overcome the mechanical and hydraulic resistances, as the machine does not have any mechanical means to effect the suction stroke. However, a small part of the driving cavity energy is always consumed by the above mentioned switching device and by other hydraulic and mechanic resistances, therefore, a small pressure drop arises between these "b" and "c" cavities.

In the previous design, having the single and common "a" cavity, this pressure drop provokes the "a" cavity to act as equilibration unit, i.e. the "a" cavity pressure value is getting median between the "b" and "c" cavities pressure values. Accordingly, the pressure values acting on the external and on the internal surface of each bellows are not equal, and the bellows should suffer from some radial deformation, to which it is not designated.

In the design according to the invention, the pressure drop between the "b" and "c" cavities is not equilibrated via "a" cavities, because the latter are not connected together hydraulically. The pressure in the "b" and "c" cavities always acts on fluid in the two independent "a" cavities via the bellows wall. The corresponding pressure in the "a" cavities compensates this action precisely and independently balances the pressure values acting on the inner and outer bellows surfaces. The achieved balance eliminates radial deformation and greatly improves the bellows life.

During operation, the "a" cavities pressure increases to the minimal necessary value, which is sufficient to avoid radial deformation of the bellows wall due to the fluid's low compressibility. This pressure does not depend on the pressure differential between the "b" and "c" cavities, which acts only on the upper and lower surfaces of plunger 6.

The arrangement according to the invention eliminates additional radial deformation of the bellows, which would inevitably arise in the previous design that has a conjoint "a" cavity.

Another advantage of the inventive solution is improved protection of the pumping fluid from the pumped fluid and vice versa. The previous design could lead to the fluids becoming mixed and corresponding machine malfunction in case of two cavities becoming non-fluid-tight in series: namely cavity "b" and conjoint cavity "a". The present solution has two independent "a" cavities and thus adds one more cavity in this series. It presents, thereby, a triple fluid protection instead of double.

The described pump operates as follows (see FIG. 2):

During the suction stroke the bellows 4 internal "c" cavity is fed by the pumped material from intake manifold 8 through lower valves module 9. The material is pumped at a small pressure (for example 3-8 bar) that moves the plunger 6 upwards. Correspondingly, the bellows 4 is stretched and bellows 10 is compressed which leads to the pumping hydraulic fluid being displaced from cavity "b" into the hydraulic driving system suction manifold. The pressure of the pumped material acting in the "c" cavity on the bellows 4 internal surface is balanced by a corresponding increase in the fluid pressure in cavity "a" which acts on the bellows 4 external surface. Similarly, the pressure increase in cavity "b" is balanced by the increase in fluid pressure in the bellows 10 external "a" cavity. As soon as the suction stroke is completed, the control system 1 switches, and pumping hydraulic fluid supplied by hydraulic drive under high pressure (for example 200 bar) is fed into the bellows 10 "b" cavity. This moves the plunger 6 downward, which generates the discharge stroke. During the discharge stroke the bellows 10 is stretched and bellows 4 is compressed. In a corresponding manner to before, the pressure in cavities "b" and "c" (which is now increasing) is balanced by means of the pressure (which increases) in the two independent cavities "a", which prevents radial deformation of the bellows 4,10 during the whole discharge stroke. The compressed pumped material is displaced from the "c" cavity through the valves module 8 into the discharge manifold 11. At the end of the discharge stroke the control system 1 switches again, and the machine working cycle starts from the beginning.

The above-described inventive arrangement results in eliminating or greatly reducing radial deformation of the bellows-like diaphragms that occurred with the prior arrangement as a result of pressure differentials, resulting in greater reliability and enhanced load capacity for the diaphragms.

The Hydromechanical Switch

Electromagnetically driven and electronically controlled directional valves are conventionally employed to control cyclic operations of hydraulic machines and mechanisms. These multilevel, sophisticated control systems complicate the hydraulic machines and decrease their reliability.

The hydraulic machine can incorporate a "hydromechanical switch" to simplify the control systems and increase the reliability of such class of machines. In this hydromechanical switch, the hydraulic openings are commutated only by mechanical means, without electronic or magnetic appliances. Use of the hydromechanical switch is capable of broadening a controlled machine's area of application in severe environmental conditions, and reduces and simplifies maintenance, staff training, etc.

Figure 3:
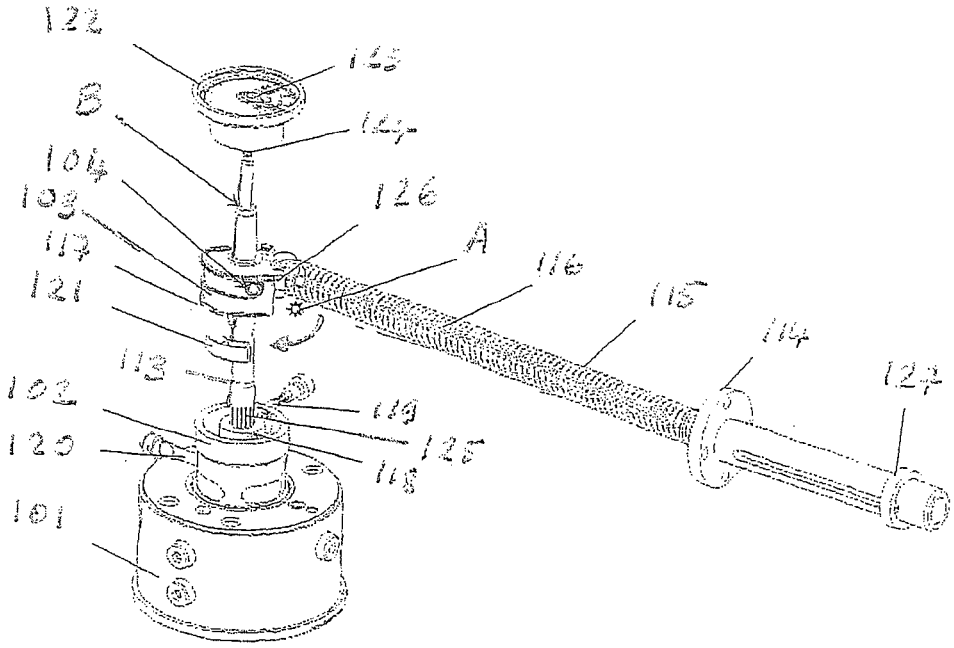
FIG. 3 is a perspective view showing the inside of a hydromechnical switch.
Figure 4:
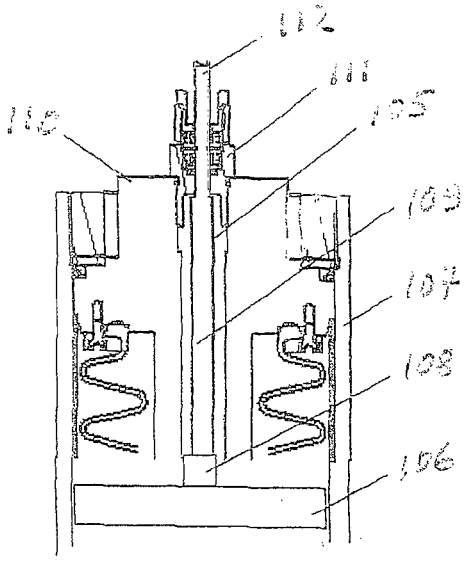
FIG. 4 diagramatically shows part of a cylinder to which a hydromechanical switch is fitted.
Figure 5:
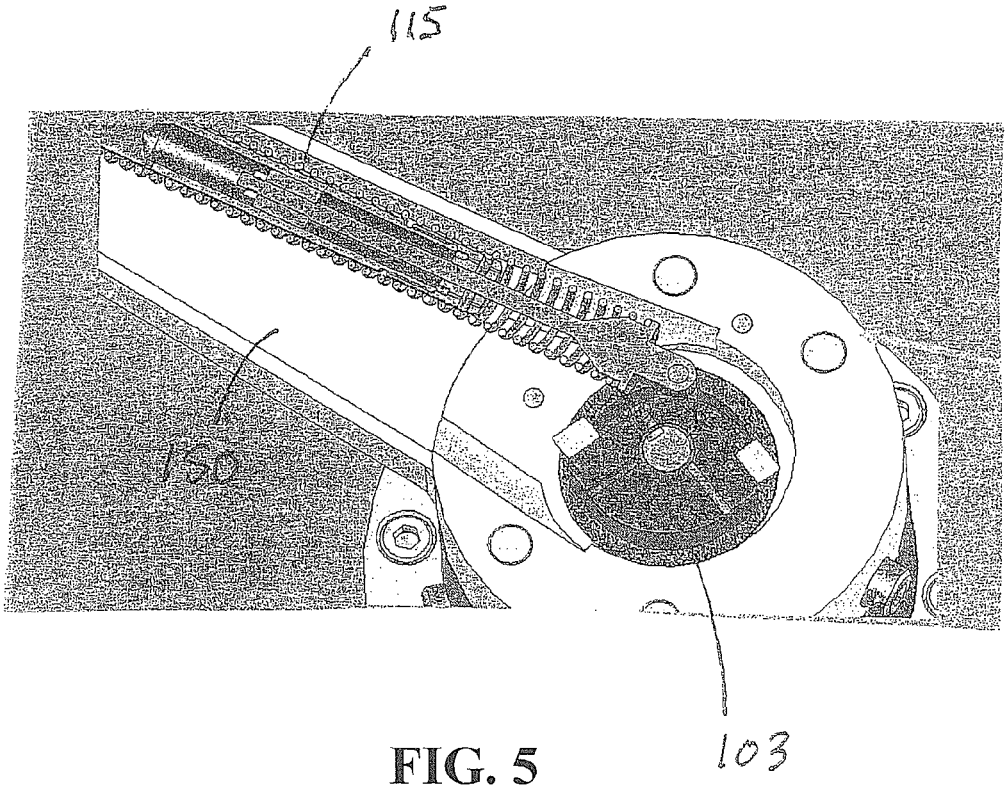
FIG. 5 is a broken-away perspective view showing the connection of the spring to the cam in the hydromechanical switch according to the invention.

The hydromechanical switch of FIGS. 3 to 5 is applicable in general to any hydraulic machine comprising a hydraulic cylinder 107 having a part namely a piston 106 mounted for cyclic reciprocating linear motion along the hydraulic cylinder 107, and means for commutating a valve 102 to control the supply of hydraulic fluid to the hydraulic cylinder at given moments of the machine's cycle. The hydromechanical switch comprises a linkage (screw nut 108, screw rod 109) for converting linear motion of the piston 106 into rotary motion; a cam 103 rotatably driven by said linkage; and a spring 115 arranged to be compressed to store energy by rotation of the cam 103 during a stroke of the piston 106. Spring 115 has one end near the cam 103 and another free end that bears against a flange 114. This spring 115 is moreover arranged to release its stored energy to commutate the valve 102 for controlling the supply of hydraulic fluid to the hydraulic cylinder 107 of the machine when the piston 106 is at given positions along the hydraulic cylinder 107.

The spring 115 is a compression spring mounted on an arm 150 (FIG. 2) extending from the cam 103 such that, on rotational drive of the cam 103 by the linkage (108,109), the end of the spring adjacent the cam is compressed until the spring reaches an unstable equilibrium point "A" past which the spring releases its stored energy to commutate said valve 102. When the spring 115 releases its stored energy it firstly abruptly drives the cam 103 through a given angle (say) 45° and then as the cam 103 continues to rotate, it rotates a part to commutate the valve 102 by turning it through, say, 45°.

Said linkage (108,109) is arranged to turn the cam through an angle less than 180° for each stroke of the piston 106. It comprises, for instance, the screw nut 108 and the screw rod 109 forming the screw gear linkage.

The working principle of the hydromechanical switch is based on the consumption of a part of the machine's linear movement energy. A small portion of this energy is taken away via a screw gear and stored in the spring 115's elastic deformation energy. This stored energy is then released to produce the necessary openings/commutations at given moments of the machine's working cycle.

The hydromechanical switch may be designed in the form of a rotating cylindrical valve (see FIG. 3), which comprises immobile housing 101, rotating valve body 102, cam 103, driving spring 115 and screw-gear (108,109) for transforming linear motion of piston 106 into rotational motion of the cam 103.

Figure 2:
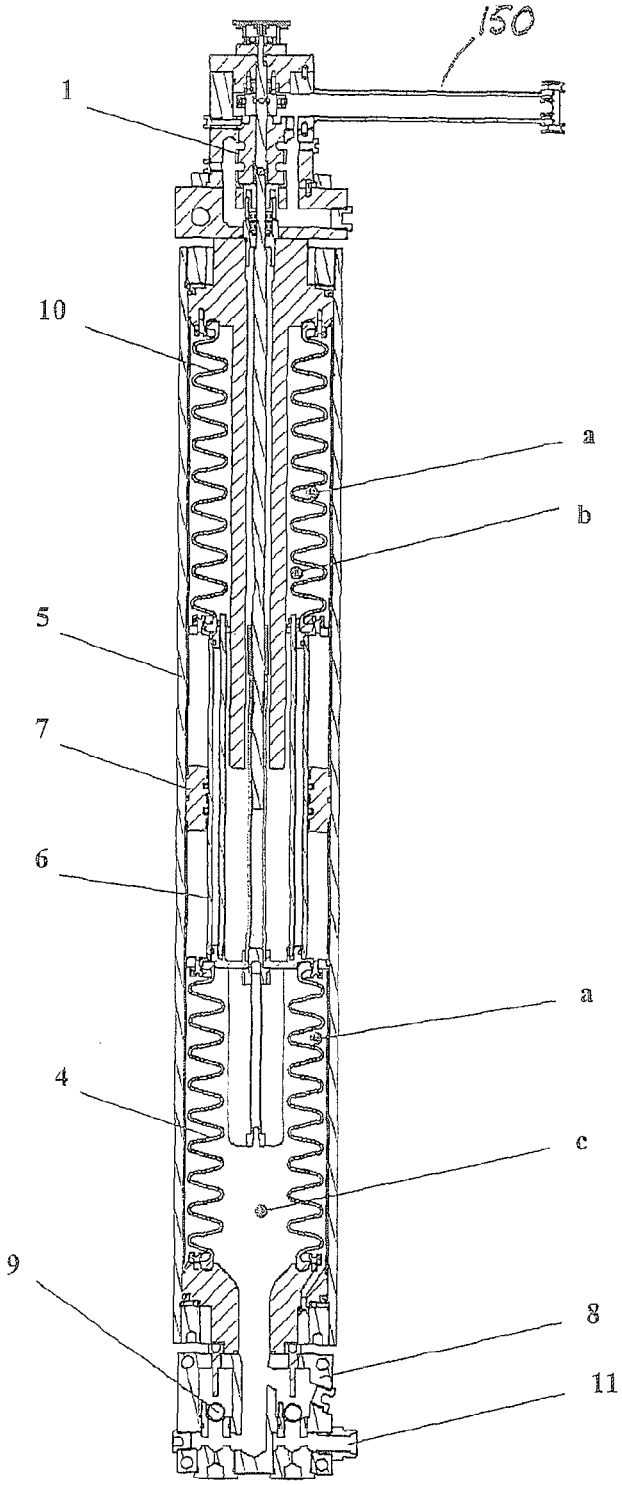
FIG. 2 is a cross sectional view of one cylinder of a pumping machine according to the invention.

When the hydromechanical switch is incorporated in the pumping machine of FIGS. 1 and 2, said part mounted for cyclic reciprocating movement along the cylinder is the piston 106 or a plunger or other part fixed thereto.

The illustrated hydromechanical switch operates as follows.

Together with the piston 106's linear motion, nut 108 is also moving. This motion causes rotation of the screw rod 109. The screw rod's axial motion is disabled via bearing and sealing unit 111. Another purpose of the unit 111 is to hold the screw 109 fluid-tightly inside the cover 110. The screw shaft 112 rotates the cam 103 through pin 113 and the finger 104. Compression of spring 115 occurs simultaneously with rotation of the cam 103. The spring pivots also about its free end and reaches an unstable equilibrium state point "A" at the end of the piston stroke. This unstable equilibrium point corresponds to the maximum compression of the spring 115, when the lateral axis of the spring 115 intersects the rotation axis of the cam 103, i.e. the spring elastic force is at it's maximum value, but produces no torque to the cam geometrically having no lever effect. The further small angle rotation of cam 103 causes a small lever arm effect, and the spring 115 stored energy release starts. FIG. 5 shows the spring laterally offset from the equilibrium position, with the spring 115 in a less-compressed state at the beginning of its compression stroke, ready to start turning.

Pivoting beyond the unstable equilibrium point "A", the spring 115 starts to release the stored energy, and the switching process starts without any liaison to the piston motion, i.e. automatically. Initially, the spring's expansion after point "A" abruptly pivots only the cam 103 as its expansion energy overcomes only the cam's joint 113 friction forces and hydraulic resistance of the damper 116. The latter is designed to stabilize the spring's motion velocity. After the cam's free rotation through about 45 degrees, its cog 117 starts to act on the valve's 112 stud 118 and brings the valve 102 into angular motion. Further rotation of the cam 103 produces simultaneous rotation of the rotating valve 102 through an angle of about 45 degrees and corresponding necessary commutation of fluid channels made in the bodies of valve 102 and of it's housing 101. The desired openings commutation for commanding the machine is thereby achieved by rotation of this valve 102.

A ball-fastener 119 is designed to limit rotation of the valve in extreme positions. The valve comes against the stop 120 and is fixed by the ball-fastener 119 at the end of the turn.

The following features increase the hydromechanical switch's reliability.

The cog 117 is equipped with a rubber damper 121 to minimize shock upon contact of the stud 118 and stop 120.

The rotating valve 102 is statically and dynamically hydraulically balanced to compensate radial pressure components that otherwise would cause undue friction during the valve's rotation.

The spring 115's compression occurs during the whole piston stroke to evenly consume it's energy. For this purpose, the spring is soft and has corresponding low resistance variation over the stroke.

The circular surface "B" of the pin 113 is sustained by balancing pressure directed from the internal cylinder's cavity through a special channel, and the surface "B" area is equal to the shaft's 112 sectional area to balance the pulling force, which acts on the screw 109 by reason of the internal cylinder's pressure.

The hydromechanical switch is equipped with an indicator 122 to observe the valve and the piston positions, motion direction, velocity and operation. Instead of a mechanical indicator any angular sensors may be employed to monitor the machine operation electronically, if required.

Involute splines 124 and 125 on the cam's shaft are designed to adjust the piston stroke and the indicator pointer 123 position during the assembly process.

Bolts 126 are designed to produce a fine tune of the cam 103 rotation angle and the whole hydromechanical switch operation.

A tunable junction 127 is designed to adjust the spring 115's performance.

After an initial fine tune, the hydromechanical switch operates automatically, i.e. the working machine commands itself. For example, if the piston velocity changes, the valve commutation still continues to happen at the right time, because the commutation process depends only on the piston position, not on velocity nor on acceleration.

Such solution increases the machine's reliability and dispenses with the need for any control system maintenance.

The invention claimed is:

1. A hydraulically driven diaphragm pumping machine, the pump comprising at least one pump cylinder (5) that has a first end with a first inlet and outlet (11) for fluid to be pumped and a second end with a second inlet and outlet (1) for hydraulic fluid, the inlets and outlets being associated with respective valves, a separator (6) located inside and movable to-and-fro along the pump cylinder, the movable separator (6) having a first side facing the first end of the cylinder and a second side facing the second end of the cylinder, wherein:

the movable separator (6) is connected to the inside of the first end of the cylinder by a first flexible diaphragm (4) in the form of a concertina-like bellows that is expandable and contractable inside the cylinder (5) along the length direction of the cylinder as the movable separator (6) moves to-and-fro along the cylinder, the first side of the movable separator delimiting a first chamber (c) inside the expandable and contractable flexible diaphragm (4) for containing a variable volume of pumped fluid in communication with the first inlet and outlet;

the movable separator (6) is connected to the inside of the second end of the cylinder (5) by a second flexible diaphragm (10) in the form of a concertina-like bellows that is contractable and expandable along the length direction of the cylinder (5) in correspondence with expansion and contraction of the first flexible diaphragm (4), the second side of the movable separator delimiting a second chamber (b) inside the second expandable and contractable diaphragm (10) for containing a variable volume of hydraulic fluid in communication with the second inlet and outlet; and an annular space is defined between the outside of the first and second diaphragms (4,10) and the inner wall of the pump cylinder (5), which annular space in use contains a second fluid that is the same as said hydraulic fluid or has similar hydraulic characteristics, characterized in that:

the movable separator (6) is in the form of an elongate plunger that has upper and lower ends and is slidably mounted in the middle part of the inside of the cylinder (5) between the first and second bellows-like diaphragms (4,10), the upper end of the plunger (6) being connected to the first bellows-like diaphragm (4) and the lower end of the plunger (6) being connected to the second bellows-like diaphragm (10) to define said annular space as respective first and second annular spaces (a) which in use each contain the second fluid namely a first annular space (a) between the outside of the first bellows-like diaphragm (4) and the inner wall of the pump cylinder (5) and a second annular space (a) between the outside of the second bellows-like diaphragm (10) and the inner wall of the pump cylinder (5), the upper end of the plunger (6) cooperating with the inner wall of the cylinder (5) to fluid-tightly isolate the first annular space (a), and the lower end of the plunger cooperating with the inner wall of the cylinder (5) to fluid-tightly isolate the second annular space (a) such that the first and second annular spaces (a) are not connected together and are independent of one another and such that the pressure of fluid in the first annular space (a) is independent of the pressure of fluid in the second annular space (a).

2. The machine of claim 1, wherein the plunger (6) is slidably mounted in a sealing element (7) secured inside a middle part of the inside of the cylinder (5).

3. The machine of claim 1, herein the outer diameter of the plunger (6) corresponds to the median working diameter of the first and second bellows-like diaphragms (4,10).

4. The machine of claim 1, wherein during operation the combined volume of the first and second spaces (a) remains essentially constant.

5. The machine of claim 1, comprising means for automatic commutating of a valve (102) to control the supply of hydraulic fluid to the pump cylinder (5, 107) at given moments of the machine's cycle, wherein said means for commutating the valve comprises a hydromechanical switch comprising:

a machine part (106) that is mounted for cyclic reciprocating linear motion along the pump cylinder (5, 107);

a linkage (108,109) for converting linear motion of said machine part (106), into rotary motion;

a cam (103) rotatably driven by said linkage (105,109); and a spring (115) arranged to be compressed to store energy by rotation of the cam (103) during a stroke of said machine part (106), and arranged to release its stored energy to commutate said valve (102) for controlling the supply of hydraulic fluid to the pump cylinder (5, 107) of the machine when said part (106) is at given positions along the pump cylinder (5, 107), i.e. for controlling the machine working cycle.

6. The machine of claim 5, wherein the spring (115) is a compression spring mounted on an arm (150) extending from the cam (103) such that on rotational drive of the cam (103) by the linkage (108,109) the end of the spring adjacent to the cam is compressed until the spring reaches an unstable equilibrium point past which the spring releases its stored energy to commutate said valve (102).

7. The machine of claim 6, wherein when the spring releases its stored energy it firstly drives the cam (103) and after the cam has turned through a given angle the cam (103) rotates a part to commutate the valve (102).

8. The machine of claim 6, wherein said linkage (109) is arranged to turn the cam through an angle less than 180° for each stroke of said machine part (106).

9. The machine according to claim 5, wherein the linkage (108,109) is a screw gear linkage comprising a nut (108) and a screw rod (109).

* * * * *